US010244845B2

(12) United States Patent
Chen

(10) Patent No.: US 10,244,845 B2
(45) Date of Patent: Apr. 2, 2019

(54) CONTAINER AND APPLICATOR FOR POWDERS AND LIQUIDS

(71) Applicant: Presto Packaging Solutions LLC, New York, NY (US)

(72) Inventor: Hongliang Chen, Shangyu (CN)

(73) Assignee: Presto Packaging Solutions LLC, New York, NY (US)

( * ) Notice: Subject to any disclaimer, the term of this patent is extended or adjusted under 35 U.S.C. 154(b) by 64 days.

(21) Appl. No.: 15/588,589

(22) Filed: May 5, 2017

(65) Prior Publication Data

US 2018/0317630 A1 Nov. 8, 2018

(51) Int. Cl.

| | |
|---|---|
| ***A46B 11/00*** | (2006.01) |
| ***A45D 34/04*** | (2006.01) |
| ***A45D 33/36*** | (2006.01) |
| ***A45D 40/26*** | (2006.01) |
| ***A45D 33/34*** | (2006.01) |

(52) U.S. Cl.

CPC ..... *A45D 34/046* (2013.01); *A45D 33/34* (2013.01); *A45D 33/36* (2013.01); *A45D 34/043* (2013.01); *A45D 34/045* (2013.01); *A45D 40/264* (2013.01); *A45D 40/265* (2013.01); *A45D 40/267* (2013.01)

(58) Field of Classification Search

CPC .. A45D 34/043; A45D 34/045; A45D 34/046; A45D 40/264; A45D 40/265; A45D 40/267; A45D 33/34; A45D 33/36

USPC ..... 401/127

See application file for complete search history.

(56) References Cited

U.S. PATENT DOCUMENTS

| | | | | |
|---|---|---|---|---|
| 7,044,670 | B2 * | 5/2006 | Delage | A45D 34/041 401/126 |
| 8,074,665 | B2 * | 12/2011 | Pires | A45D 33/00 132/293 |
| 9,345,307 | B2 * | 5/2016 | Eberlein | A45D 34/045 |
| 9,456,676 | B2 * | 10/2016 | Suzuki | A45D 33/006 |
| 9,986,811 | B2 * | 6/2018 | Yang | A45D 34/045 |

* cited by examiner

*Primary Examiner* — Jennifer C Chiang

(74) *Attorney, Agent, or Firm* — Levisohn Berger LLP

(57) ABSTRACT

A container for inks, paints, cosmetics, and the like, having a sponge applicator affixed within the container's threaded cap, is provided. When the cap is attached to the container, the sponge fits closely within a perforated mask located in the neck of the container. The mask controls the amount of material that can be transferred to and carried by the applicator when it is removed from the container. In preferred embodiments, the sponge applicator is automatically extended from the cap as the cap is removed from the container, and is automatically retracted into the cap as the cap is screwed onto the container.

2 Claims, 5 Drawing Sheets

CONTAINER AND APPLICATOR FOR POWDERS AND LIQUIDS

RELATED APPLICATIONS

There are no related applications.

FIELD OF THE INVENTION

This invention relates to containers and applicators for powdered and liquid materials, and in particular containers and applicators for inks, coatings, pigments, and cosmetics.

BACKGROUND

Containers having caps with attached applicators are well known for the storage and dispensing of coatings and powders. Bottles of nail polish, typist's white-out, and touch-up paint, all having soft brushes attached to the caps, are common examples, as are tubes of mascara with bristle brushes similarly incorporated into the caps.

"Sponge puff" applicators are increasingly popular, because they permit smooth and uniform application of a powder or liquid coating with easy blending, and can be used for both dry and wet coatings, pigments, and cosmetic materials. They are particularly suited for application of a cosmetic base or foundation. Foamed elastomeric materials that are ordinarily used for this type of applicator include acrylonitrile-butadiene rubber (NBR), ethylene-propylene-diene terpolymers (EPDM), urethane rubbers, silicone rubbers and the like. A fine, open-cell structure is generally preferred, at least for the outer layer of the applicator.

Prior art applicators must generally be dipped or immersed in the coating or powder which is to be applied, and it is difficult for the user to control the amount of material that is carried on the sponge. Excess material, or an insufficient amount of material, can make it difficult for the user to apply a smooth and even coating.

It is also desirable that the overall package be compact, which in prior art containers is accomplished by having the brush deeply inserted into the container when the cap is closed. This deep insertion results in an excess of material on the brush when it is withdrawn. There remains a need for a compact applicator and associated container, in which the amount of material transferred to and carried by the applicator is easily controlled.

SUMMARY OF THE INVENTION

The present invention provides a container for a liquid coating or powder material, a threaded cap for the container, and a sponge applicator affixed to the inner portion of the cap. A perforated mask is present in the neck of the container. When the cap is screwed onto the container so as to close and seal the container, the sponge is in close proximity to, or in contact with, the mask, which in turn is shaped to closely fit the surface of the sponge.

The method of use comprises shaking the container so that a portion of the contained powder or liquid passes through the perforations in the mask. Where the contents are a powdered material, the powder is adsorbed on the surface of the sponge, and may be retained in any surface pores of the sponge. To the extent that the sponge possesses an open-celled structure, liquid materials may enter more deeply into the sponge. An optional space between the sponge and mask may permit the material to be distributed over the surface of the sponge applicator, but the spacing is sufficiently close to prevent an unacceptable amount of material to be carried on the applicator when it is removed from the container.

In preferred embodiments, as detailed below, the sponge is mounted to the interior of the cap via a rotating holder, which moves helically with respect to the cap in such a way that the sponge applicator retracts into the cap as the cap is screwed onto the container, and extends from the cap as the cap is removed from the container. The cap and rotating holder, together, thus provide the sponge with a handle of convenient length when the cap is removed from the container, while the cap and rotating holder telescope to a shorter length when the cap is threaded back onto the container. A wiper in the neck of the container holds the sponge by friction, keeping it stationary relative to the container; this causes the cap to rotate relative to the holder, resulting in the telescopic action. In the closed configuration, the sponge is in contact, or near-contact, with the perforated mask, and by shaking the container, the user can re-load the sponge with the contained powder or liquid.

DETAILED DESCRIPTION OF THE INVENTION

In the illustrated embodiment, the sponge is mounted on a cylindrical sponge holder, the holder being rotatably engaged with the interior of the cap via lugs that ride in helical threads on the interior of the cap, so that the holder is helically moveable with respect to the cap, and telescopes inwardly and outwardly as it rotates. The pitch of the cap threads, by which the cap is reversibly attached to the container, may be an integer multiple of the pitch of the threads which engage the holder, the integer being the number of lugs on the holder as explained below. The applicator, when the cap is screwed onto the container, is pressed through a close-fitting cylindrical wiper, the wiper having an inner diameter just slightly smaller than the outer diameter of the sponge applicator. Resistance provided by the grip of the wiper inhibits rotation of the sponge, so that as the cap is screwed onto the container, the sponge and attached holder are held motionless with respect to the container, and the holder moves helically with respect to the cap due to the threaded connection of the rod with the interior of the cap. As a result, the rod and sponge applicator retract telescopically into the cap as the cap is screwed onto the container.

The holder is of such a length that it bottoms out within the cap before the cap is fully engaged with the container. This forces the holder, and the sponge, to begin rotating with the cap, and to move axially with the cap. The sponge is thus forced past the wiper, and comes into contact, or near-contact, with the mask just as the cap reaches the fully-closed position, with the holder being fully retracted into the cap.

Due to friction between the wiper and the sponge, the sponge remains in place as the cap is removed, and the sponge holder is likewise held stationary with respect to the container. The holder and sponge therefore move helically with respect to the cap, causing the holder and sponge to be extended outward from the cap until the holder reaches the limit of axial travel permitted by the inner threads. At this point, again, the holder and the sponge are forced to begin rotating with the cap, and to move axially with the cap. Thus, once the holder fully extended from the cap, the sponge moves against the resistance provided by the wiper, is drawn away from the shield, and exits the container.

Figure 1:
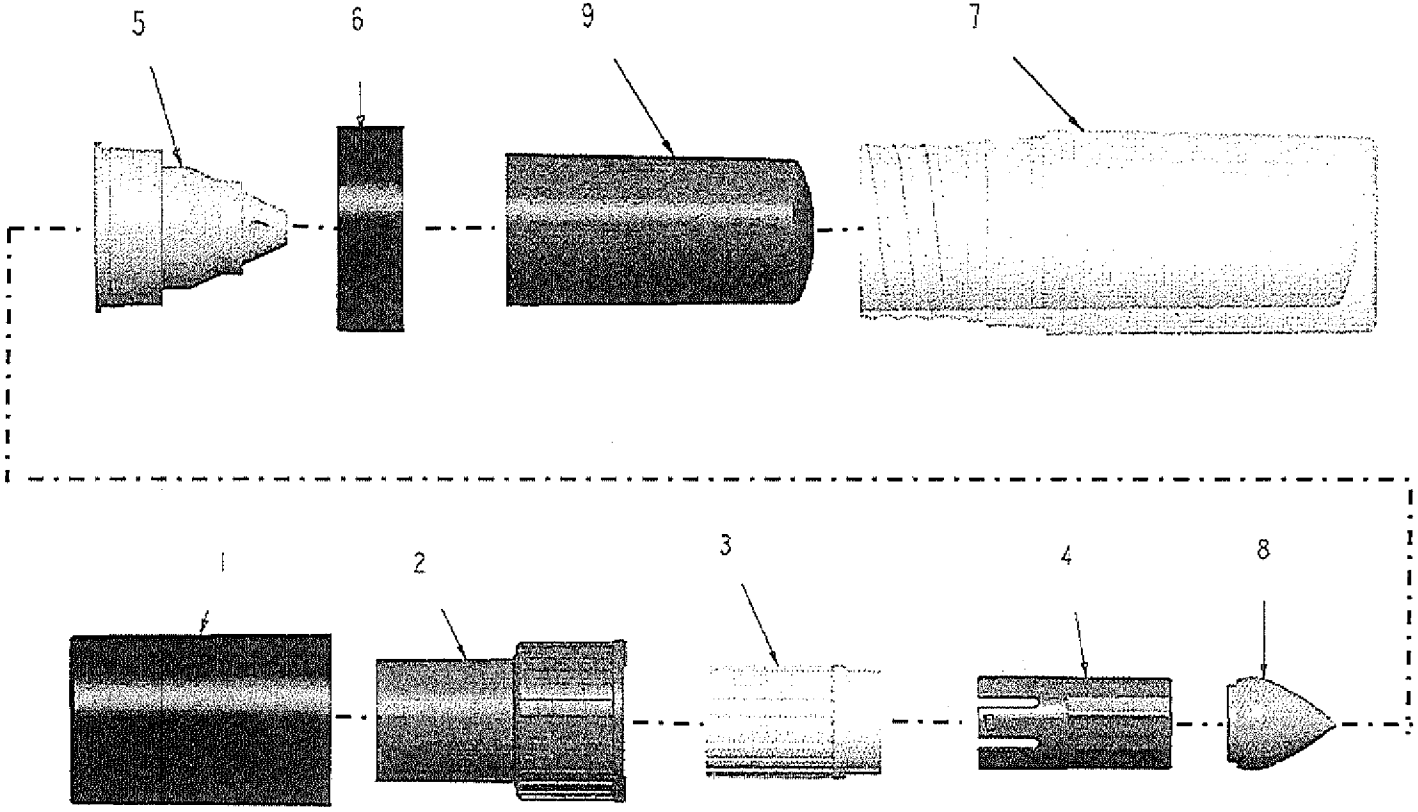
FIG. 1 is an exploded view of one embodiment of the applicator and container of the invention, with the elements in solid representation.

Turning to the drawings, FIG. 1 shows an exploded view of the components of a preferred embodiment of the invention. A decorative outer cap 1 has press-fitted within it an inner cap 2, which features internal cap threads (11 in FIG. 4) which are complementary to the external threads 10 on the container 7. Disposed on the inner surface of inner cap 2 are internal splines, which engage with complementary external splines on the screw sleeve 3 (see FIGS. 3 and 4). Screw sleeve 3 is inserted within inner cap 2, so that the splines are engaged and prevent relative rotation of inner cap 2 and sleeve 3. Disposed on the interior of screw sleeve 3 are second threads 12. In an alternative embodiment, the cap threads 11 and the second threads 12 can be integral to a single molded cap.

Holder 4 is a hollow cylinder, fixedly attached to sponge 8 at the distal end and divided by longitudinal slots at the near end into four substantially identical arc-shaped sections. Sponge 8 is formed from an elastomer foam, as is known in the art, and may have any desired shape.

Shield 5 is generally shaped to conform to the surface of the sponge, and in this embodiment it is integral with a cylindrical collar that serves as the wiper for the sponge. In alternative embodiments, the wiper may be a separate device, or it may be integral to the neck of the container. The wiper may have an inner diameter B just slightly smaller than the outer diameter A of the sponge applicator. The shield is perforated to permit the contents 9 of container 7 to contact the sponge. The contents 9 are shown as a uniform mass, which represents a powdered or liquid material having taken the shape of the interior of the container. Mask 6 is an optional, decorative collar that fits around container 7. Outer cap 1, when screwed into place, will typically come to rest against mask 6 when the container is sealed.

Figure 2:
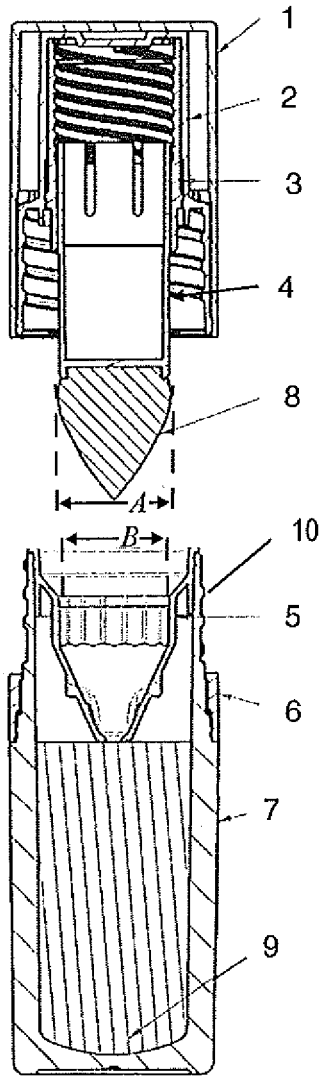
FIG. 2 is a cutaway representation of the assembled cap and applicator from FIG. 1, aligned with the assembled container from FIG. 1.

FIG. 2 shows, in cross-section, the elements of FIG. 1 when assembled into the separate cap and container of the invention. The sponge 8 and sponge holder 4 are shown in the fully-extended configuration.

Figure 3:
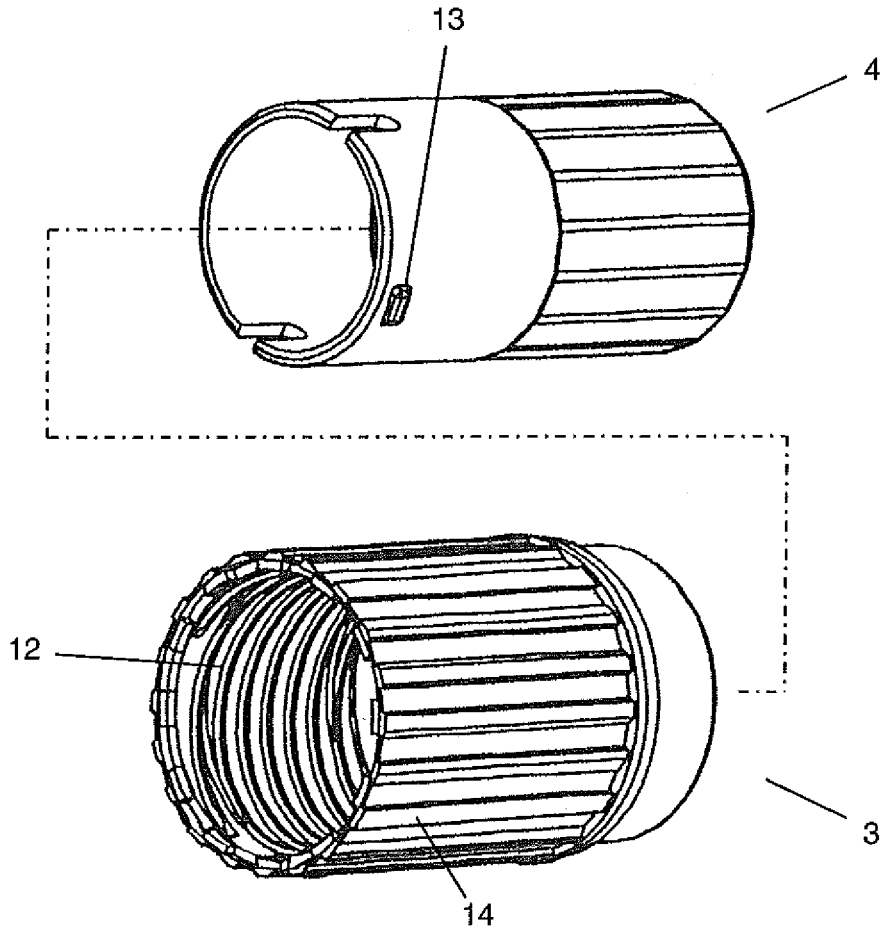
FIG. 3 is a perspective view of an alternative embodiment of the screw sleeve 3 and rotating sponge holder 4.

Turning to FIG. 3, the screw sleeve 3 and holder 4 are shown in perspective. This is an alternative embodiment in which the near end of the holder 4 is divided by two longitudinal slots into two substantially identical arc-shaped sections. On the exterior surface of each section is a protruding lug 13, the two lugs being symmetrically disposed around the perimeter of the holder. The diameter of the holder 4 is just slightly less than the inner diameter of the screw sleeve 3, so that it may freely rotate therein. The shape and thickness of the lugs closely matches the shape and depth of the internal threads 12 of the sleeve 3, so that the lugs can freely slide along the roots of the threads. The longitudinal slots in 4 are sufficiently deep to render the arc-shaped sections flexible enough to allow the lugs 13 to ride over the crests of the internal threads 12 when the near end of the holder 4 is pressed into the screw sleeve 3. After insertion, each lug will then rest on the root of a thread. In the embodiment illustrated, the threads 12 are in the form of a double spiral, i.e. a two-start thread. In alternative embodiments, the second threads may be in the form of three-start, four-start, or higher threads, depending on the structure of the sponge holder 3.

It will be apparent that the holder 4 may be divided by three longitudinal slots into three sections, and bear three lugs, and in general may be divided by n slots into n sections and bear n lugs. The inner threads 12 will then preferably be an n-start thread, comprising n coaxial helices. Alternative equivalents are contemplated, for example a single-start thread may be employed in sleeve 3 if the two lugs in the illustrated embodiment are offset in the axial direction by ½ of the thread pitch. In general, offset lugs make it possible to employ 2n, 3n, or more lugs with an n-start thread. The effective pitch of the threads, i.e. the net axial translation of the lugs as the holder rotates 360° within the sleeve, preferably matches the effective pitch of the threads holding the outer cap to the container, and the various combinations of lugs, threads, and offsets that arrive at this result are all within the scope of the invention.

Figure 4:
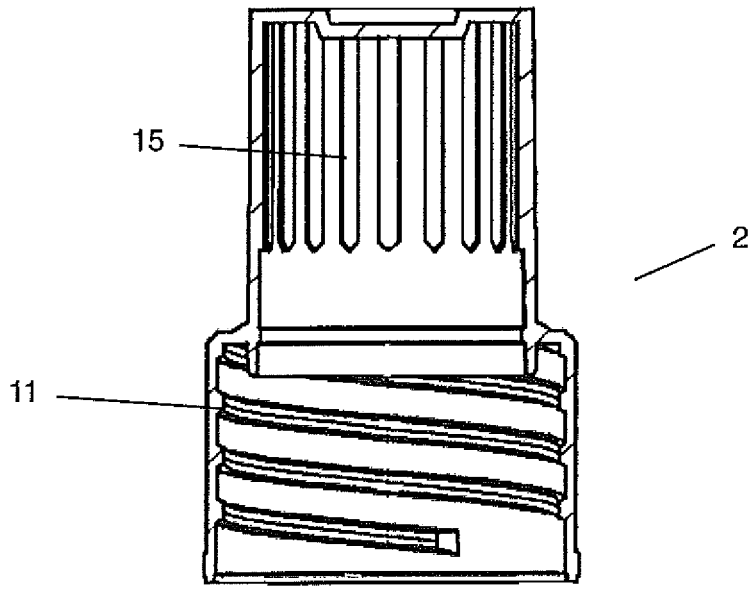
FIG. 4 is a cutaway view of the inner cap 2 from FIG. 1.

FIG. 4 shows the inner cap 2 in cross-section. Threads 11 are complimentary to the outer threads on the container. The inner splines 15 in the upper part of the cap mate with the splines 14 on the outer surface of the screw sleeve 3.

Figure 5:
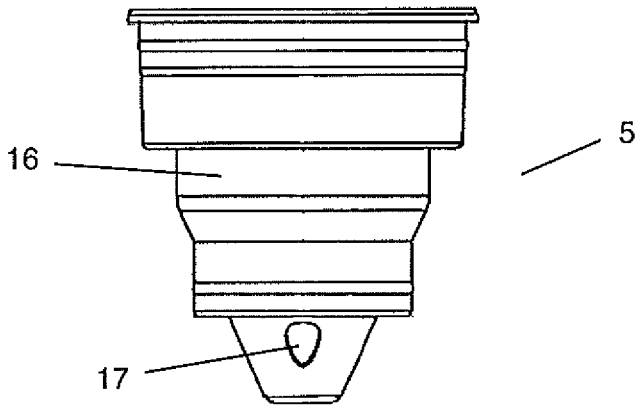
FIG. 5 is a side view of the perforated mask 5 from FIG. 1.

FIG. 5 is a side view of the shield 5. The inner surface (not shown) conforms to the shape of the sponge. The inner surface of the collar 16 serves as the wiper that holds the sponge in fixed position relative to the container, causing the cap and the sponge holder to rotate relative to one another. The perforation 17 is one of several that may be present; the tip of the shield may feature a central perforation as well. The dimensions, number and placement of the perforations, and the amount of space between sponge and shield, are largely at the discretion of the practitioner, and will be chosen with due regard for the properties of the powder or liquid, and the quantity desired to be transferred to the sponge.

Figure 6:
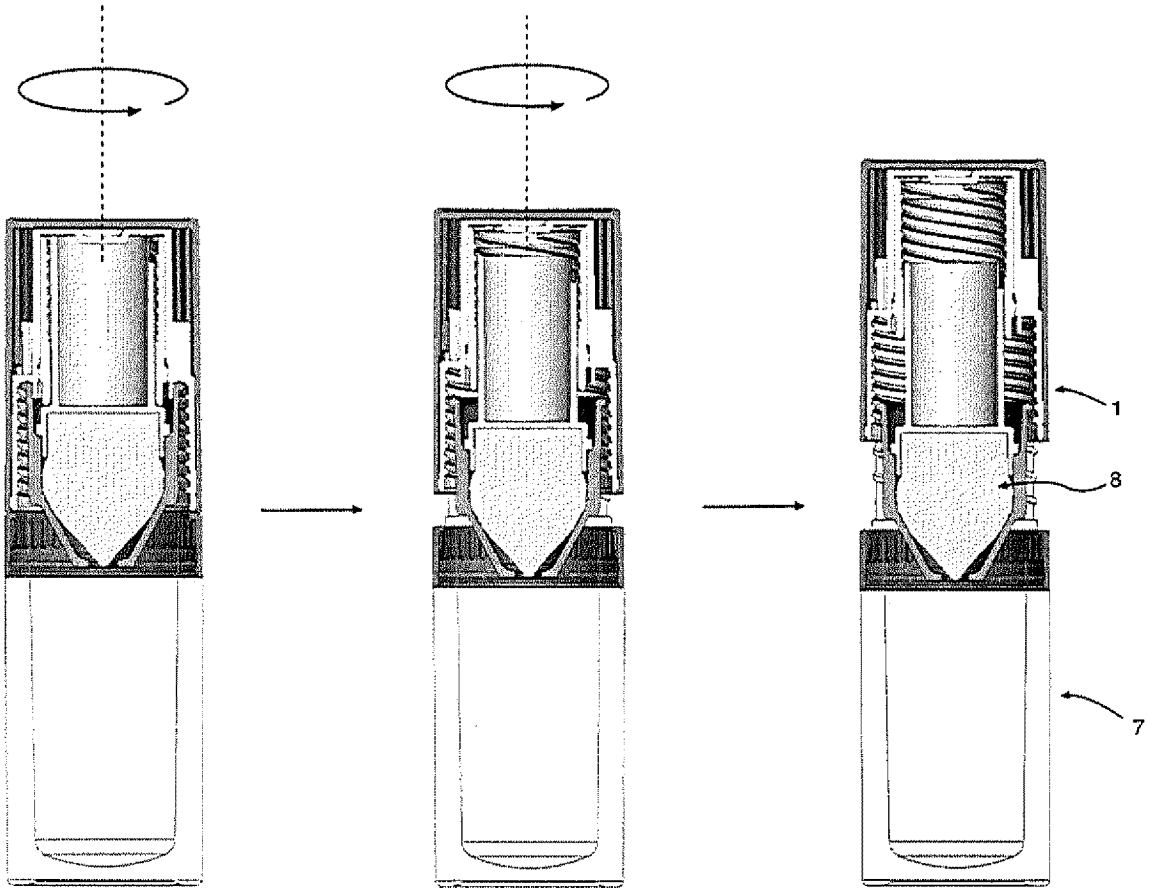
FIG. 6 is a cutaway view, showing the motion of the cap relative to the sponge as the cap is removed from the container.

FIG. 6 illustrates the relative motions of the cap 1 and sponge 8 as the cap 1 is rotated and removed from the container 7.

The invention has been illustrated in the drawings, and described above in terms of specific, exemplary embodiments, but such variations and modifications as will be obvious to one of skill in the relevant arts, and variations in proportions and dimensions, are considered to be within the scope and spirit of the invention as set forth in the claims.

I claim:

1. A combined container cap and applicator, for the transfer of a powdered or liquid material from the container and for application of the material to a substrate, comprising an applicator sponge mounted to the interior of the cap via a rotating holder, and a wiper mounted to the container, wherein (a) the cap is a threaded cap, the threads being a first set of threads which are complimentary to threads on the container;

(b) the holder moves helically with respect to the cap; and (c) the wiper reversibly holds the sponge by friction in a fixed position relative to the container when the container is closed by the cap; such that (d) when the cap is unscrewed from the container, the wiper holds the sponge and the holder fixed relative to the container, causing the holder and sponge to move helically outward relative to the cap, and (e) when the cap is screwed onto the container, the wiper holds the sponge and the holder fixed relative to the container, causing the holder and sponge to move helically inward relative to the cap;

whereby the helically outward and helically inward motions, respectively, result in a telescopic motion of the holder outward and inward with respect to the cap.

2. The combined container cap and applicator according to claim 1, comprising:

(a) a cylindrical holder with a near end and a distal end, the cylindrical holder having an external surface upon which two or more lugs are diposed on said external surface, the lugs being symmetrically disposed around the circumference of the holder at the near end, and the cylindrical holder having the sponge fixedly attached to the distal end;

(b) a second set of internal threads within the interior of the cap, the second set of threads being so dimensioned as to slidably engage the lugs within the second set of threads; and (c) a cylindrical wiper fixed within the neck of the container, having an internal circumference less than the circumference of the sponge, through which the sponge can be passed by the application of force the wiper thereby providing resistance against rotation of the sponge.

* * * * *